US006168014B1

(12) United States Patent
Manservigi et al.

(10) Patent No.: US 6,168,014 B1
(45) Date of Patent: Jan. 2, 2001

(54) CIGARETTE PACKET

(75) Inventors: Alberto Manservigi, Bologna; Fiorenzo Draghetti, Medicina, both of (IT)

(73) Assignee: G. D S.p.A., Bologna (IT)

( * ) Notice: Under 35 U.S.C. 154(b), the term of this patent shall be extended for 0 days.

(21) Appl. No.: 09/253,723

(22) Filed: Feb. 22, 1999

(30) Foreign Application Priority Data

Mar. 11, 1998 (IT) ..... BO98A0146

(51) Int. Cl.[7] ..... A24F 15/00
(52) U.S. Cl. ..... 206/268; 206/273; 229/106
(58) Field of Search ..... 206/265, 266, 206/268, 269, 271, 273; 229/106, 108; 220/837, 657

(56) References Cited

U.S. PATENT DOCUMENTS 898,125 * 9/1908 Marcuse ..... 206/265
926,944 * 7/1909 Hope ..... 206/266
1,152,429 * 9/1915 Marcuse ..... 206/266
1,519,137 * 12/1924 Hothersall ..... 206/265
1,827,396 * 10/1931 Luckett ..... 206/266
1,830,583 * 11/1931 Woller ..... 206/266
4,531,652 * 7/1985 Hara ..... 220/667
4,923,059 * 5/1990 Evers et al. ..... 206/265
5,044,550 * 9/1991 Lamm ..... 229/160.1
5,916,611 * 6/1999 Bell ..... 426/95

FOREIGN PATENT DOCUMENTS 0545723 6/1993 (EP) .
0764594 3/1997 (EP) .
0814025 12/1997 (EP) .
773138 4/1957 (GB) .

* cited by examiner

*Primary Examiner*—Paul T. Sewell
*Assistant Examiner*—Nhan Lam
(74) *Attorney, Agent, or Firm*—Pillsbury Madison & Sutro LLP

(57) ABSTRACT

A cigarette packet of the rigid type having a hinged lid presents four side faces of which at least one is convexly profiled and associated with the two adjoining side faces along dihedral angles that are effectively obtuse, softening the contours of the packet.

8 Claims, 4 Drawing Sheets

CIGARETTE PACKET

BACKGROUND OF THE INVENTION

The present invention relates to a cigarette packet.

In particular, the present invention relates to a cigarette packet of the type with a hinged lid, comprising a cupped container having one open end, and a lid hingedly associated with the container and capable of movement in relation to the container away from and toward a position in which the open end is enclosed.

Direct reference is made throughout the following specification to a packet of this type, albeit with no limitation in general scope implied.

Familiar rigid packets of the type in question are generally parallelepiped in appearance, having a predominating longitudinal axis and presenting four side faces arranged in two mutually opposed and parallel pairs, all four disposed parallel to the longitudinal axis. There are certain drawbacks associated with such packets, especially for the consumer, since each two adjoining side faces meet along a sharp right angle corner edge subtending a right dihedral angle. Not only are the sharp corner edges relatively unergonomic, they also occasion wear on the pockets of garments in which the packet normally will be carried.

The object of the present invention is to provide a cigarette packet free of the drawbacks mentioned above and, more particularly, a packet characterized by ease of use.

SUMMARY OF THE INVENTION

The stated object is realized according to the present invention in a cigarette packet having a predominating longitudinal axis and presenting four side faces arranged in two mutually opposed and parallel pairs, all four disposed parallel to the longitudinal axis, the essential feature of such a packet being that at least one side face of the four appears convexly profile and is associated with two adjoining side faces along respective substantially obtuse dihedral angles.

BRIEF DESCRIPTION OF THE DRAWINGS

The invention will now be described in detail, by way of example, with reference to the accompanying drawings in which.

DESCRIPTION OF THE PREFERRED EMBODIMENTS

Figure 1:
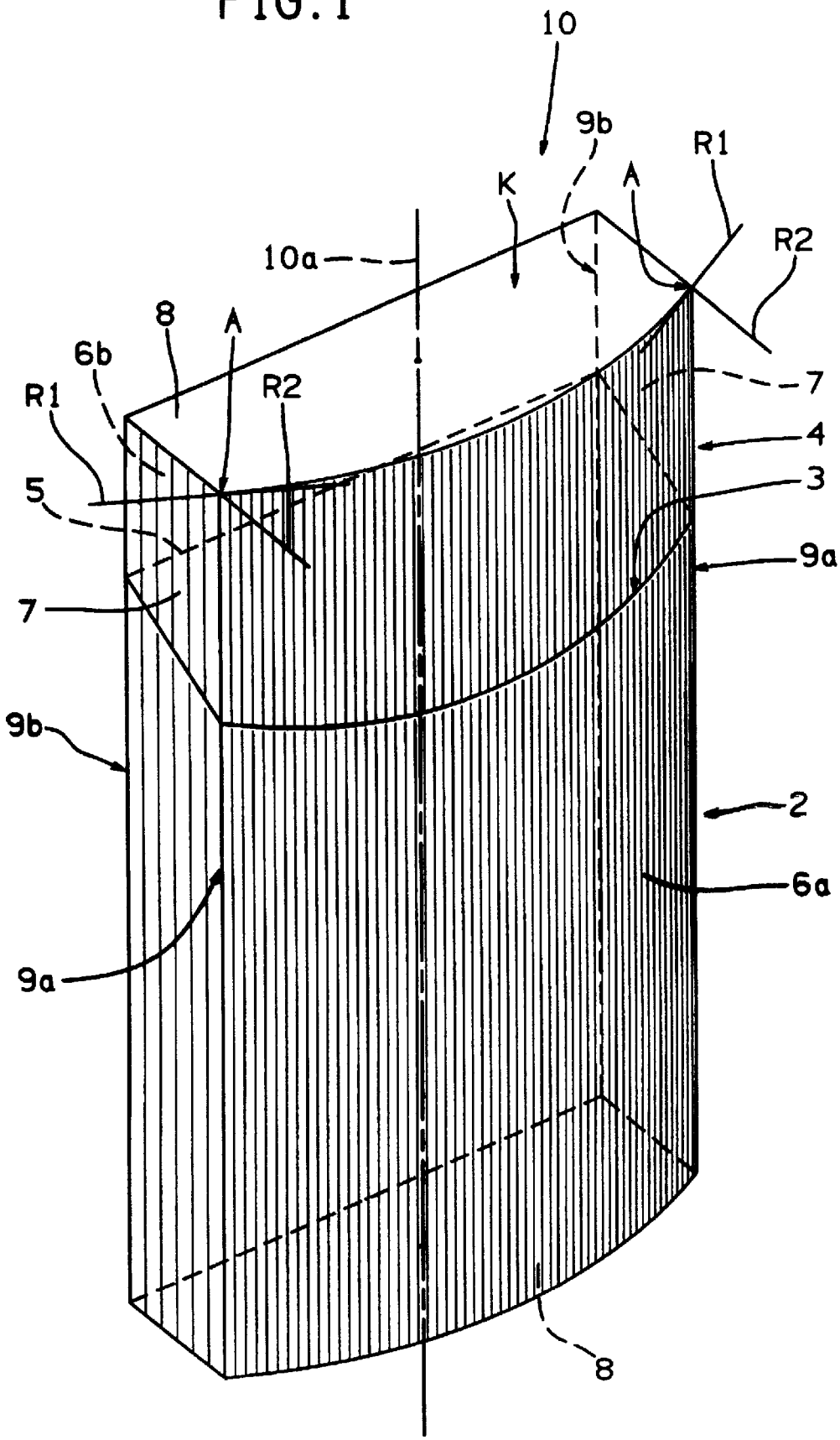
FIG. 1 illustrates a first preferred embodiment of the cigarette packet according to the invention, viewed in perspective.

Referring to FIG. 1 of the drawings, 10 denotes a rigid cigarette packet of the type with a hinged lid, appearing substantially parallelepiped in shape with a predominating longitudinal axis 10*a,* which comprises a container 2 of cupped embodiment presenting an open top end 3, and surmounting the container, a lid 4 likewise of cupped appearance attached to the container 2 along a hinge crease 5 and rotatable thus away from and toward a position in which the top end 3 is enclosed.

The packet 10 has two mutually opposed larger side faces 6, two flank faces 7, likewise mutually opposed, and two end faces 8 disposed transversely to the side faces 6 and 7 and to the longitudinal axis 10*a*. The two larger side faces 6 of the packet 10 consist of a front face 6*a* and a rear face 6*b* combining respectively with the flank faces 7 to form two front corner edges 9*a* compassing the front face 6*a* laterally, and two rear corner edges 9*b* compassing the rear face 6*b* laterally; all four corner edges 9*a* and 9*b* are disposed parallel to the longitudinal axis 10*a*.

The hinge crease 5 runs across the rear face 6*b* transversely to the longitudinal axis 10*a,* while the rear face 6*b* and the flank faces 7 are flat and the rear corner edges 9*b* present a sharply defined right angle profile. By contrast, the front face 6*a* exhibits a convex profile, appearing substantially as a cylindrical sector of which a given straight line generator extends parallel to the longitudinal axis 10*a,* with the result that the front face 6*a* and the flank faces 7 are joined at substantially obtuse angles along well defined corner edges 9*a,* and the two respective dihedral angles A subtended by the selfsame edges 9*a* are likewise substantially obtuse.

It will be seen in particular that the packet 10 is compassed in any given plane K transverse to the longitudinal axis 10*a* and in the neighborhood of the corner edges 9*a* by two straight lines R1, lying tangential to the convexly profiled front face 6*a,* and two respective straight lines R2 tangential to the flank faces 7, which combine to form respective substantially obtuse plane angles A.

Figure 2:
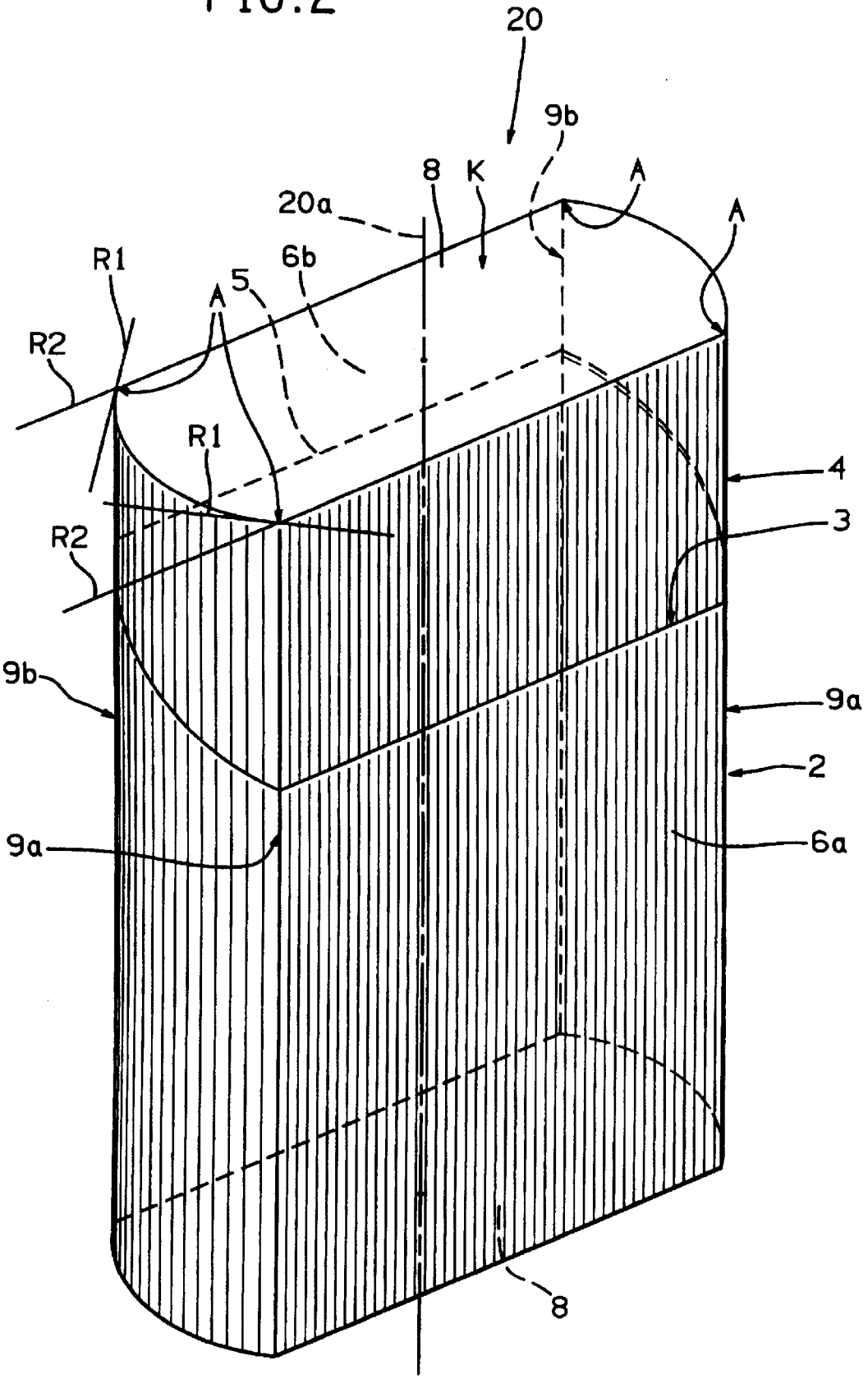
FIG. 2 illustrates a second preferred embodiment of the cigarette packet according to the invention, viewed in perspective.

The packet 20 illustrated in FIG. 2 is similar to the packet 10 of FIG. 1 though with some differences. First the larger side faces 6*a* and 6*b* are flat, disposed parallel both with one another and with a predominating longitudinal axis 20*a* of the packet 20. Second each of the two flank faces 7 exhibits a convex profile: thus, both the front corner edges 9*a* and the rear corner edges 9*b* subtend respective substantially obtuse dihedral angles A.

In this embodiment, the hinge crease 5 extends between the two convexly profiled flank faces 7. The straight lines denoted R1 lie tangential to the selfsame flank faces 7 in the neighborhood both of the front corner edges 9*a* and of the rear corner edges 9*b,* while the straight lines denoted R2 lie tangential to the front and rear faces 6*a* and 6*b* likewise in the neighborhood of the four corner edges 9*a* and 9*b,* and are also mutually parallel.

Figure 3:
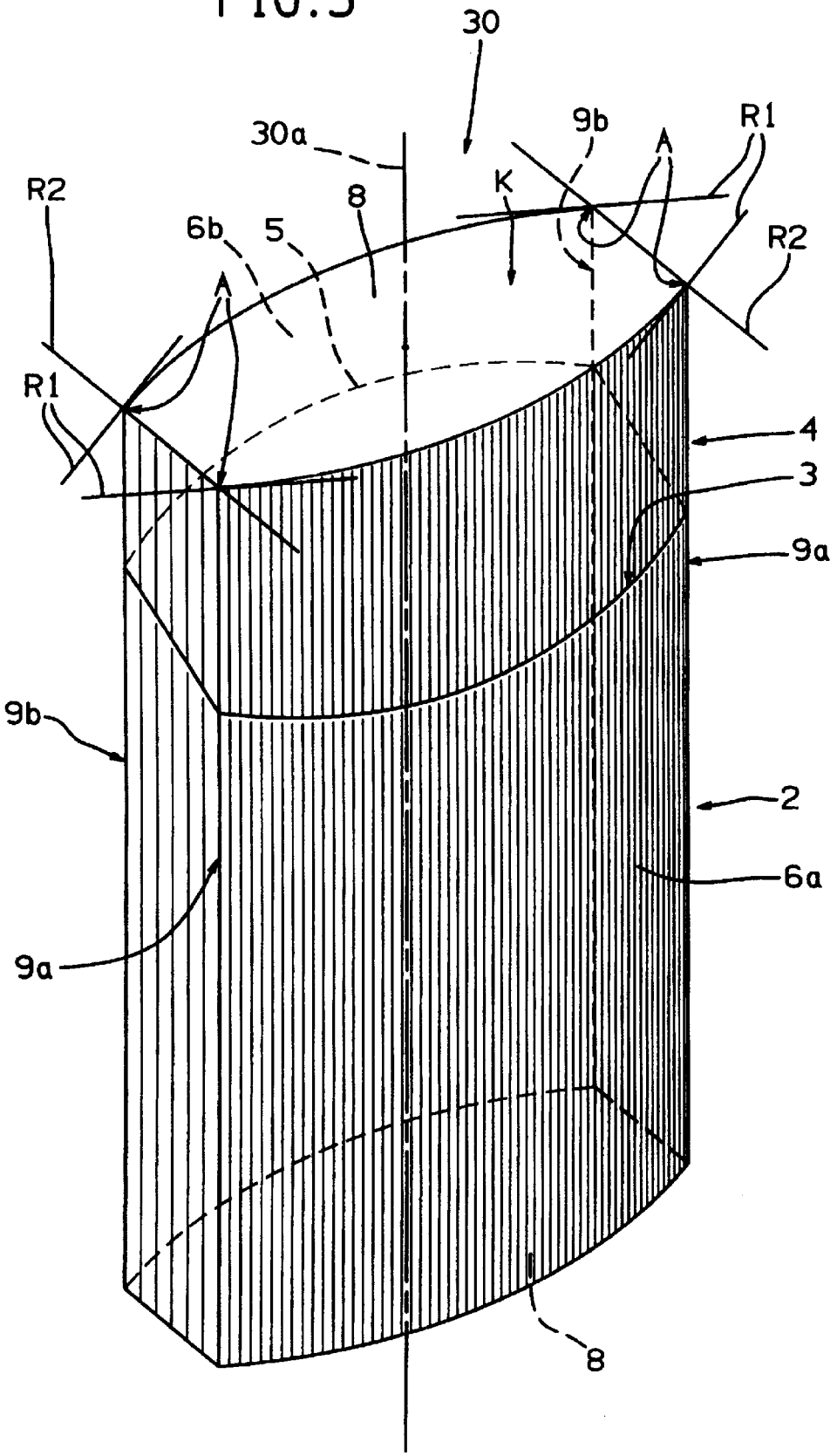
FIG. 3 illustrates a third preferred embodiment of the cigarette packet according to the invention, viewed in perspective.

The packet 30 illustrated in FIG. 3 is similar to the packet 10 of FIG. 1 with two differences. First, the two larger side faces 6*a* and 6*b* are both convexly profiled, with the front corner edges 9*a* and the rear corner edges 9*b* subtending respective substantially obtuse dihedral angles A. Second, the hinge crease 5 extends across the convexly profiled rear face 6*b*.

Figure 4:
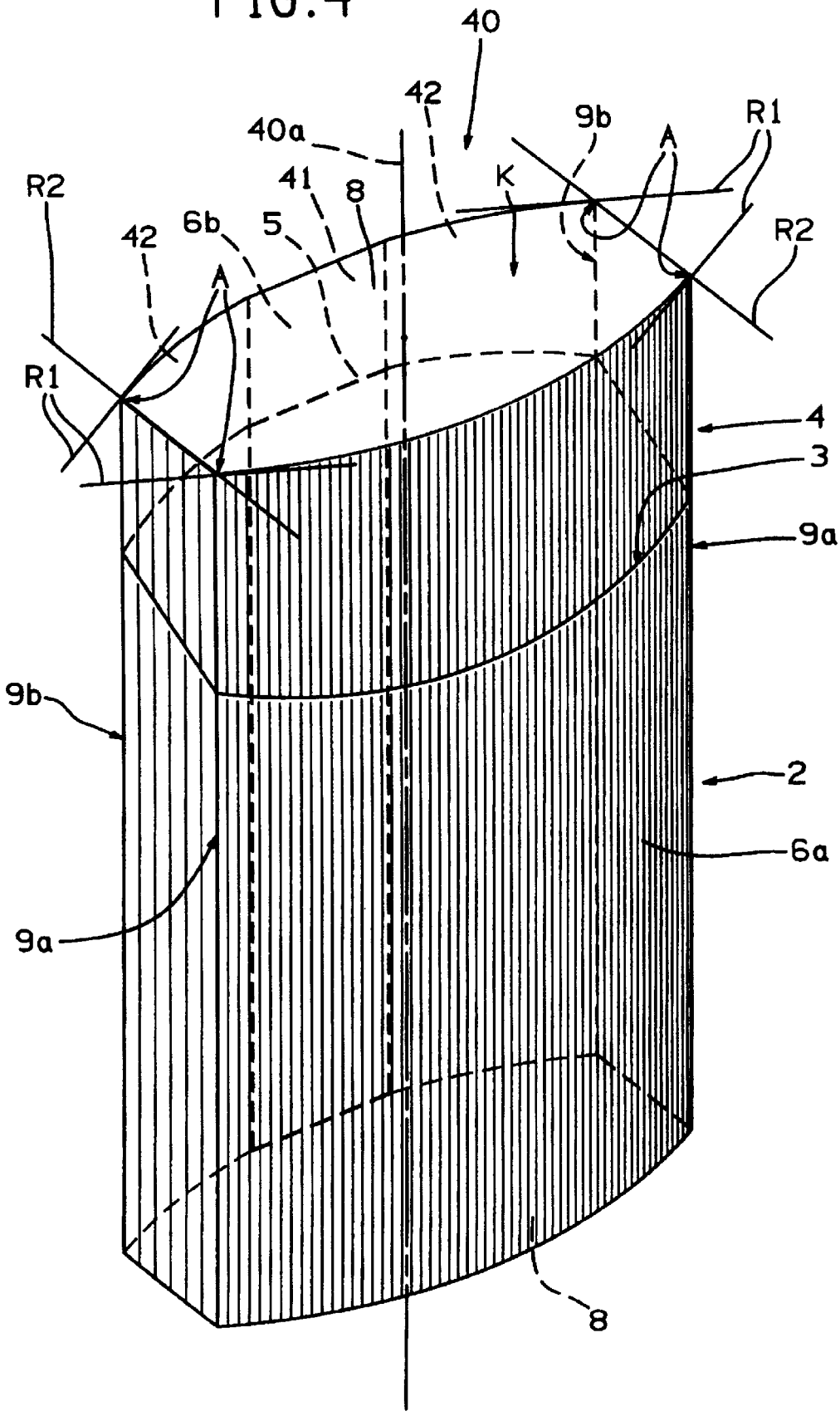
FIG. 4 illustrates a fourth preferred embodiment of the cigarette packet according to the invention, viewed in perspective.

The packet 40 illustrated in FIG. 4 is similar to the packet 30 of FIG. 3, though with the difference that the rear face 6*b* exhibits a central portion 41 disposed parallel to a predominating longitudinal axis 40*a* of the packet 40 and two convexly profiled lateral portions 42 flank the central portion 41 on either side.

In this embodiment, the hinge crease 5 extends at least across the central portion 41, and may also extend across the lateral portions 42.

What is claimed:

1. A cigarette packet having a longitudinal axis, comprising:

four side faces disposed in mutually opposed pairs parallel to the longitudinal axis of the packet, each side face having two lateral edges, each side face joined to another side face along each lateral edge;

a lid having a hinged connection to at least one of the side faces along a crease, the lid being hingedly movable between an open and closed configuration, the crease extending transverse to the longitudinal axis along one of the side faces, at least one of the side faces having a profile convex in a plane perpendicular to the longitudinal axis and substantially straight in a direction parallel to the longitudinal axis, wherein each angle, formed by a pair of lines which lie in a plane which is perpendicular to the longitudinal axis and which lines are tangential to the cigarette packet at each lateral edge of each convex profiled side face, is an obtuse angle, wherein one pair of opposed side faces has a profile convex in a plane perpendicular to the longitudinal axis and substantially straight in a direction parallel to the longitudinal axis, wherein at least one of the two convexly profiled side faces includes a flat central portion and two convexly profiled lateral portions on either side of the central portion.

2. A packet as in claim 1; wherein one pair of opposed side faces is larger than the other pair and the side face having a convex profile is one of the larger side faces.

3. A packet as in claim 2, wherein the side face having a convex profile is a front face of the packet.

4. A packet as in claim 1, wherein the pair of opposed side faces having a convex profile is larger than the other pair of side faces.

5. A packet as in claim 1, wherein the pair of opposed side faces having a convex profile is smaller than the other pair of side faces.

6. A packet as in claim 1, comprising, the lid hinged to the container along a crease extending transversely to the longitudinal axis, wherein the hinge crease extends at least across the flat central portion.

7. A cigarette packet having a longitudinal axis, comprising:

four side faces disposed in mutually opposed pairs parallel to the longitudinal axis of the packet, each side face having two lateral edges, each side face joined to another side face along each lateral edge;

a flat top and a flat bottom disposed perpendicular to the longitudinal axis;

at least one of the side faces having a profile convex in a plane perpendicular to the longitudinal axis and substantially straight in a direction parallel to the longitudinal axis, wherein each angle formed by a pair of lines perpendicular to the longitudinal axis and tangential to the cigarette packet at each lateral edge of each convex profiled side face is an obtuse angle, wherein one pair of opposed side faces has a profile convex in a plane perpendicular to the longitudinal axis and substantially straight in a direction parallel to the longitudinal axis, wherein at least one of the two convexly profiled side faces includes a flat central portion and two convexly profiled lateral portions on either side of the central portion.

8. A packet as in claim 7, comprising, a lid hinged to the container along a crease extending transversely to the longitudinal axis, wherein the hinge crease extends at least across the flat central portion.

* * * * *